US007181039B2

(12) United States Patent
Stiles et al.

(10) Patent No.: US 7,181,039 B2
(45) Date of Patent: Feb. 20, 2007

(54) THERMAL CHIMNEY EQUIPPED AUDIO SPEAKER CABINET

(75) Inventors: Enrique M. Stiles, Imperial Beach, CA (US); Richard C. Calderwood, Portland, OR (US)

(73) Assignee: Step Technologies Inc., Minneapolis, MN (US)

( * ) Notice: Subject to any disclaimer, the term of this patent is extended or adjusted under 35 U.S.C. 154(b) by 37 days.

(21) Appl. No.: 10/768,197

(22) Filed: Jan. 30, 2004

(65) Prior Publication Data

US 2005/0169494 A1 Aug. 4, 2005

(51) Int. Cl.
*H04R 25/00* (2006.01)

(52) U.S. Cl. ..... 381/397; 381/354

(58) Field of Classification Search ..... 381/337–339, 381/340, 345, 164, 373, 382, 384, 386, 387, 381/395, 189, 397, 346, 348, 349, 162, 344
See application file for complete search history.

(56) References Cited

U.S. PATENT DOCUMENTS 4,210,778 A * 7/1980 Sakurai et al. ..... 381/397
4,811,403 A * 3/1989 Henricksen et al. ..... 381/87

* cited by examiner

*Primary Examiner*—Suhan Ni
(74) *Attorney, Agent, or Firm*—Richard Calderwood

(57) ABSTRACT

A thermally conductive chimney tube extends through a loudspeaker cabinet that encloses a volume of air heated by a speaker driver. The open ends of the chimney are outside the cabinet. A column of air within the chimney is in contact with the external ambient air, but sealed off from the enclosed volume of air. As the speaker driver heats the enclosed volume of air, the material of the chimney transfers the heat to the column of air, which rises and carries the heat away into the external ambient air, cooling the inside of the loudspeaker cabinet and thus cooling the speaker driver.

10 Claims, 9 Drawing Sheets

THERMAL CHIMNEY EQUIPPED AUDIO SPEAKER CABINET

BACKGROUND OF THE INVENTION

1. Technical Field of the Invention

This invention relates generally to cooling of audio loudspeakers, and more specifically to an apparatus for extracting heat from an audio loudspeaker cabinet.

2. Background Art

FIG. 1 illustrates, in perspective view with a cutaway, a typical audio loudspeaker cabinet or enclosure 3 according to the prior art. A speaker driver 5 is mounted to a front panel or baffle 7 of the cabinet. A rear panel 9, top panel 11, bottom panel 13, right panel 15, and left panel 17 form a sealed enclosure which encloses a volume EV of air. The cabinet may be supported by legs 19. A wide variety of cabinet shapes are available; the simplistic cube shown here is for illustrative purposes only.

Loudspeaker enclosures may be sealed, as shown, or they may be vented, which is sometimes referred to as ported. A sealed cabinet has essentially zero air exchange with the outside ambient air. Vented cabinets have a hole, generally termed a port, extending through one of the panels. As the speaker driver operates, it pressurizes and depressurizes the cabinet in accordance with the oscillating motion of the driver's diaphragm. In a ported cabinet, this causes some amount of air exchange between the enclosed volume of air and the external ambient air, through the port hole. Most ported cabinets include a tuning duct which is coupled to the port and extends some distance into the enclosed volume. This duct significantly reduces the amount of air exchanged between the enclosed volume and the outside, because it generally results in an oscillating column of air moving back and forth in the duct, with very little opportunity for air inside the enclosed volume to actually pass entirely out the duct and escape to the external air, and vice versa.

In many applications, it is desirable to drive the loudspeaker very hard, to produce high sound pressure levels or loud sound volumes. Speaker drivers can produce large amounts of heat when driven hard. Significant engineering efforts are expended to improve speaker drivers' ability to tolerate heat and to extract heat away from the area of their voice coils, where the heat is produced, in order to increase power handling.

Most audio speaker cabinets are fabricated of materials, such as plywood or medium density fiberboard, which have relatively high thermal resistance. Thus, heat which is produced by the speaker driver tends to build up and remain trapped inside the cabinet. Cabinets could be made more thermally conductive, such as by fabricating them out of aluminum or the like, but materials which offer good thermal conductivity often have unacceptable acoustic properties, high cost, high mass, and/or high manufacturing cost, as compared to the conventionally used materials.

What is needed is a speaker cabinet which provides improved thermal extraction, and which can be manufactured of conventional or otherwise desirable materials.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

DETAILED DESCRIPTION

Figure 1:
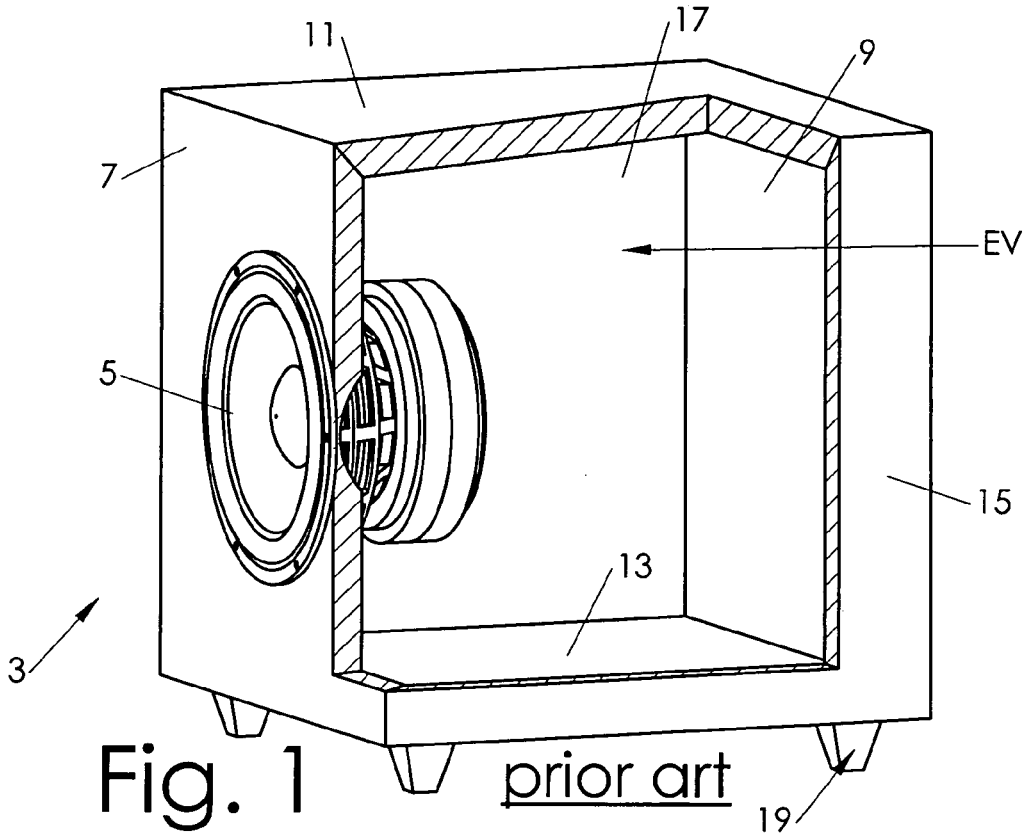
Fig. 1 prior art
FIG. 1 shows a perspective view, with a cutaway, of a loudspeaker enclosure according to the prior art.
Figure 2:
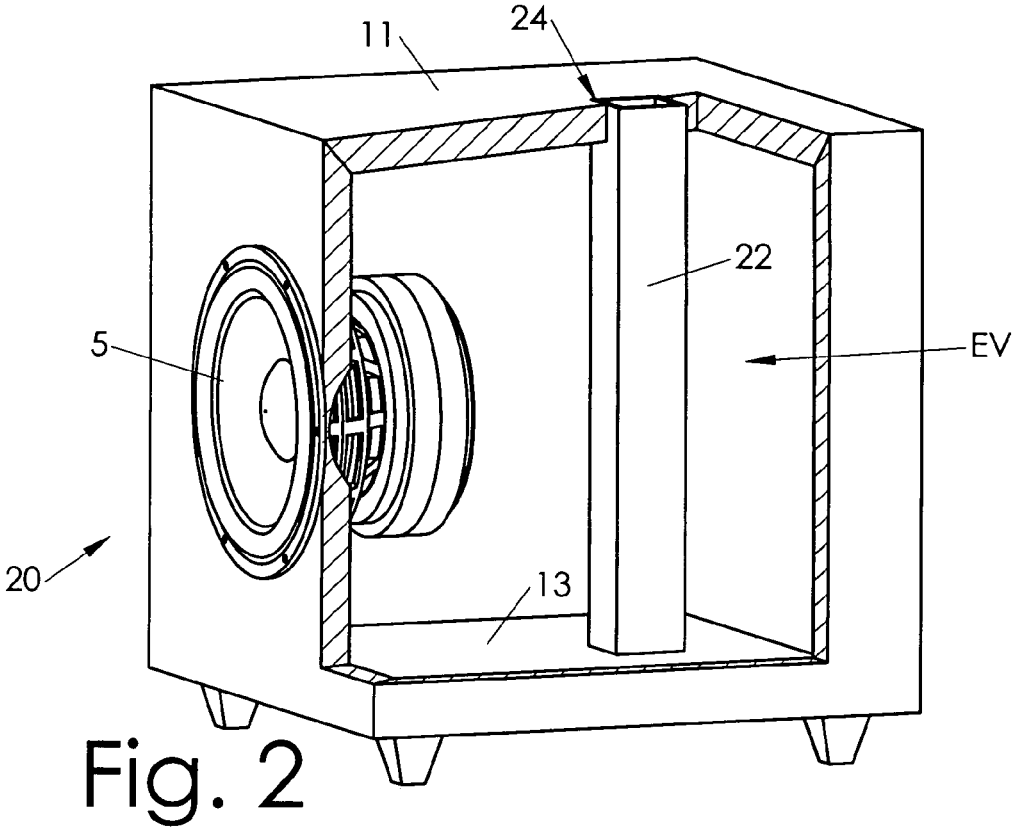
FIG. 2 shows a perspective view, with a cutaway, of a loudspeaker enclosure having a thermal chimney according to one embodiment of this invention.

FIG. 2 illustrates one embodiment of a loudspeaker cabinet 20 according to one embodiment of this invention. The cabinet encloses a sealed volume of air EV. A speaker driver 5 is coupled to the cabinet, and produces heat which is transferred to this internal volume of air. A hollow, vertical tube or chimney 22 extends completely through the cabinet. The chimney tube includes an outer surface which is in contact with the enclosed volume, and an inner surface which is in contact with a column of external ambient air. The cabinet remains sealed, and the chimney does not permit leakage between the sealed volume of air and the external ambient air. The upper end of the chimney may be flush with a hole 24 through the top panel 11 of the cabinet, and the lower end (not visible) of the chimney may be flush with a hole through the bottom panel 13.

The chimney is fabricated of a material having greater thermal conductivity than the cabinet, such as aluminum, brass, copper, or even steel. Ideally, the chimney material is also rigid, so it does not flex, compress, or deflect in response to changes in internal pressure within the cabinet when the speaker is being driven. A variety of cross-sectional shapes may be employed, such as square or circular. The circular shape offers the greatest inherent resistance to compression or deflection. Some chimneys may be simple tubes, while others may include, for example, internal cross webs for increased strength. It may, in some applications, be found advantageous to make the tube walls as thin as possible, such as for reducing weight; such internal webs may permit a greater reduction in tube wall thickness within a required level of resistance to compression or deflection. Webs can also increase surface area, improving thermal transfer.

As the enclosed volume of air EV is heated, the heat is readily conducted from the enclosed volume through the material of the chimney, heating the column of air inside the chimney. This causes the column of air to expand, which lowers its density, causing it to rise. The result is a passive, silent cooling solution yielding an upward airflow through the chimney, drawing cool air into the bottom opening, and expelling heated air out the top opening, thereby continuously extracting heat from the chimney, cooling the enclosed volume of air within the cabinet. The greater the temperature differential between the enclosed volume and the external ambient, the faster the heated column of air will rise through the chimney, and the more effective the cooling will be. The cooling is accomplished without moving parts, silently, and without adding any extra energy to the system.

Figure 3:
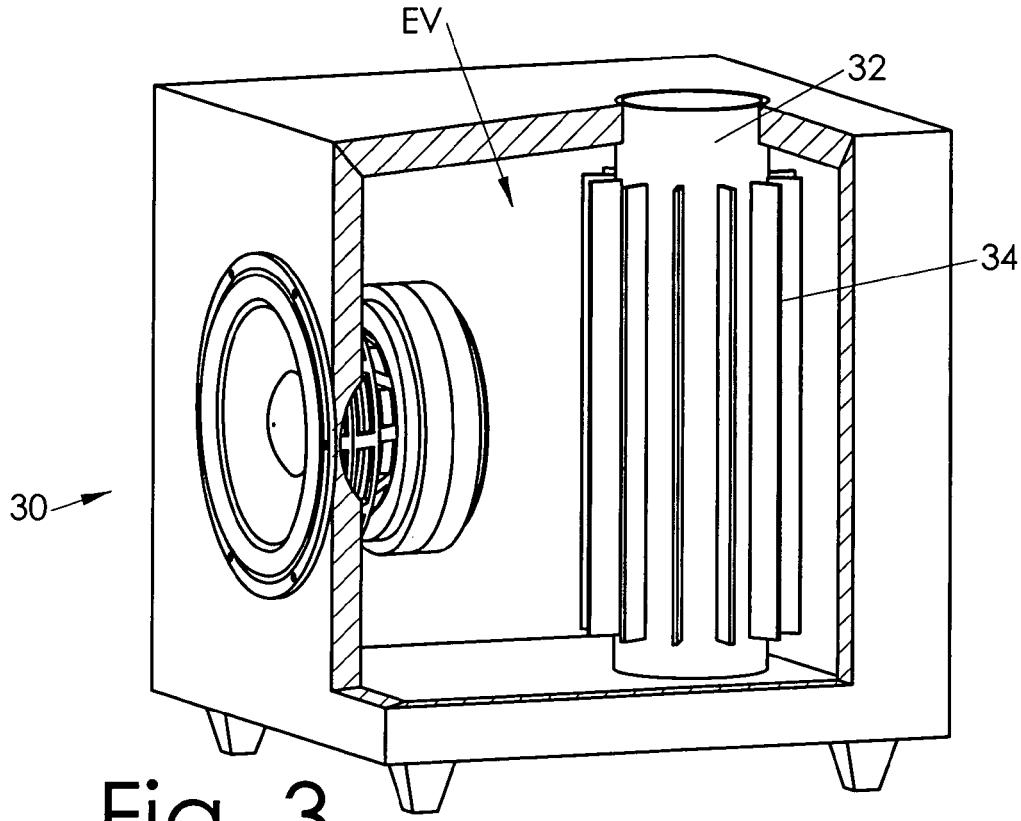
FIG. 3 shows a loudspeaker enclosure having a thermal chimney according to another embodiment of this invention, in which the thermal chimney includes fins for increased surface area and improved thermal transfer.

FIG. 3 illustrates another embodiment of the invention, in which a speaker cabinet 30 is equipped with a vertical chimney 32 having fins 34 which increase the surface area of the chimney which is in contact with the heated, enclosed air, improving its thermal extraction. The chimney may include fins both on the outer surface which is in direct contact with the enclosed air volume EV, and also on the inner surface which is in direct contact with the vertical column of air within the chimney.

Figure 4:
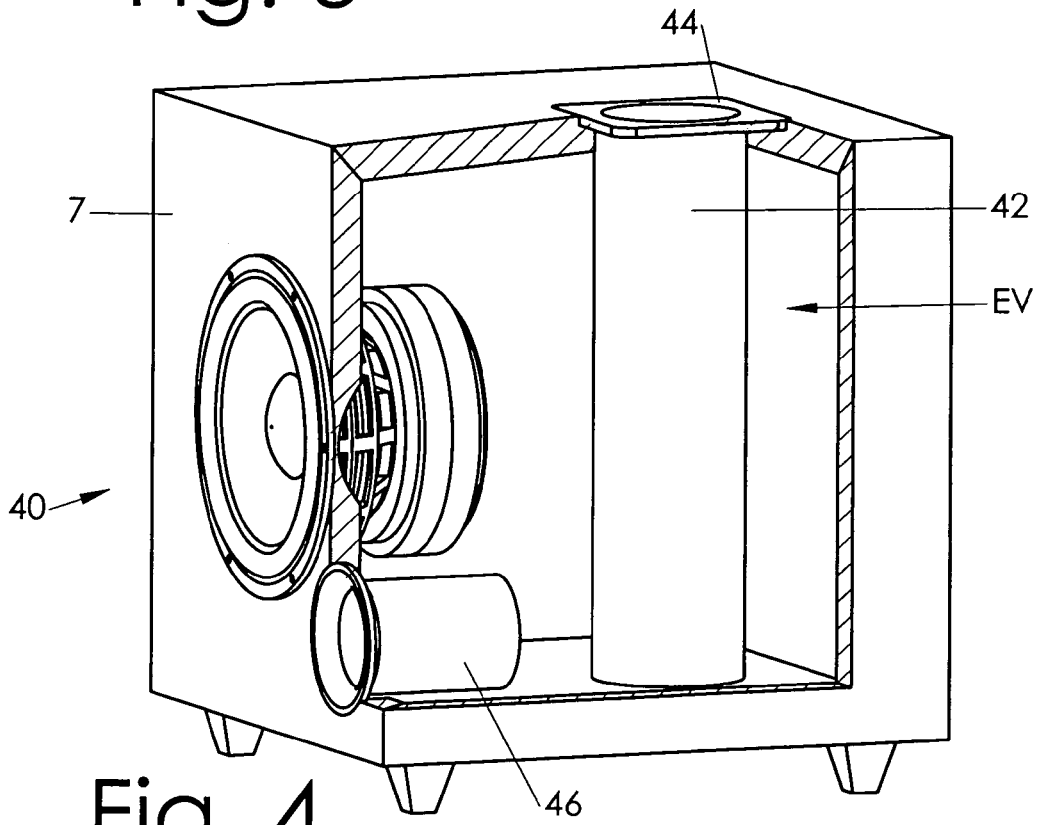
FIG. 4 shows a ported loudspeaker enclosure according to another embodiment of this invention.

FIG. 4 illustrates one embodiment of a loudspeaker cabinet 40 having a vertical chimney 42 which is equipped with a flange 44. The flange provides a more secure mounting of the chimney to the cabinet. Optionally, the flange may be recessed flush into the panel of the cabinet, as shown. The cabinet further includes a ducted port 46 extending through e.g. the front baffle 7 and into the enclosed volume EV some distance.

Placing a cylindrical or rounded chimney tube directly behind the loudspeaker has the additional advantage of scattering backwaves and reflected waves in many different directions, significantly reducing any propensity of the cabinet to develop standing waves or patterns.

Figure 5:
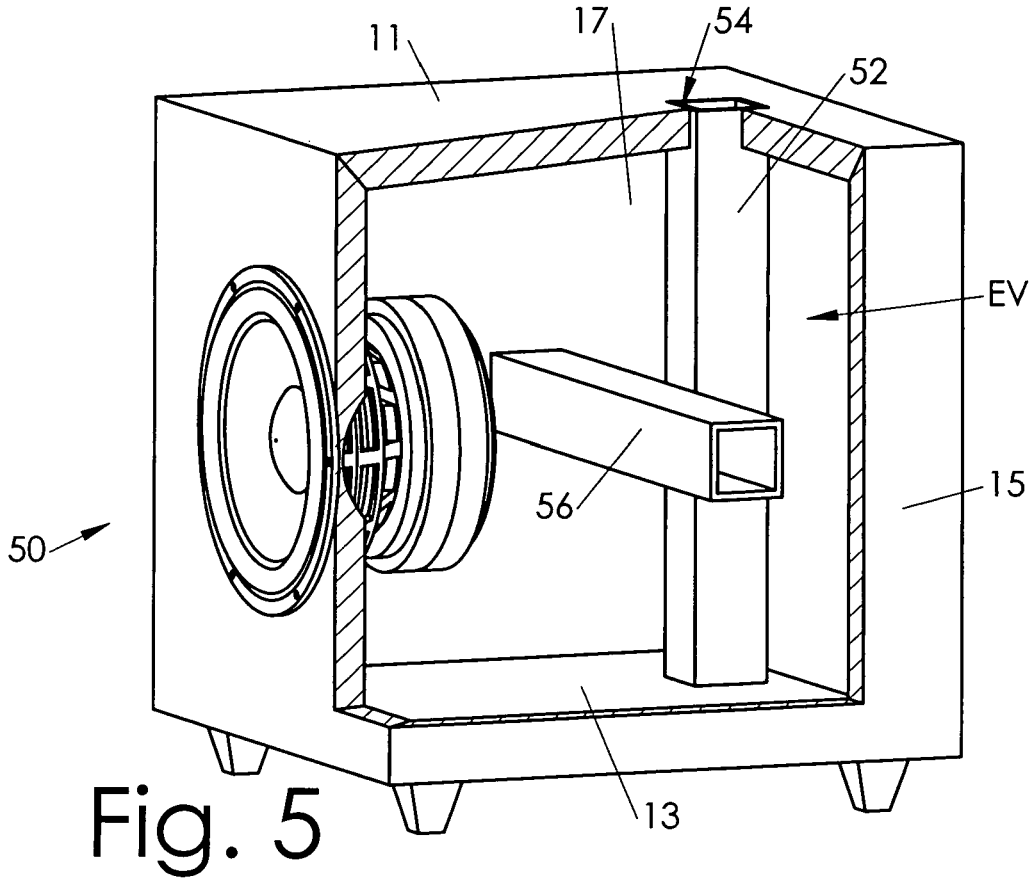
FIG. 5 shows a loudspeaker enclosure according to another embodiment, in which there are two thermal chimneys in different orientations.

FIG. 5 illustrates another embodiment of a loudspeaker cabinet 50 having a vertical chimney 52 which passes through a hole 54 in the top panel 11 and a hole in the bottom panel 13, and also a horizontal chimney 56 which passes through a hole in the right panel 15 and a hole in the left panel 17. (The portion of the right panel which would include this hole has been removed by the cutaway.) The horizontal chimney may provide some small amount of cooling, but will be much less efficient than the vertical chimney, because it will not develop the rising column effect in any significant measure. However, the addition of the horizontal chimney enables the speaker cabinet to be placed either on its bottom, as shown, or on its side. When the cabinet is placed on its side (and the surface which is now facing downward is, of course, equipped with feet to provide airspace clearance), the chimney 56 will be in the vertical position and highly effective, while the chimney 52 will be in the horizontal position and less effective. Optionally, a third chimney (not shown) could be added in the third dimension, passing through the front and rear panels, enabling the cabinet to be placed with the loudspeaker facing upward or downward.

Figure 6:
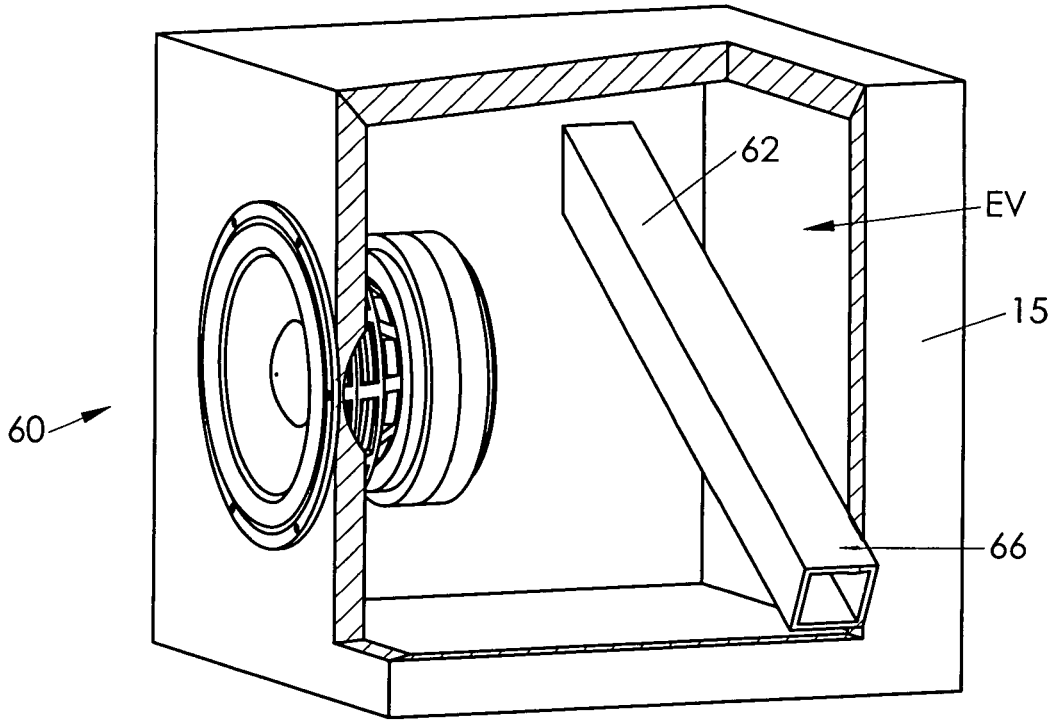
FIG. 6 shows a loudspeaker enclosure according to another embodiment, in which the thermal chimney is angled, allowing it to function without the need for feet on the speaker cabinet.

FIG. 6 illustrates another embodiment of a loudspeaker cabinet 60 in which the chimney 62 is placed at an angle, rather than strictly vertical. An angled chimney is nearly as efficient as a vertical chimney in many applications. The chimney need not necessarily end flush with the hole (not shown, owing to the cutaway) through the panel, but that it can include a portion 66 which extends out beyond the cabinet panel 15. In some applications, it may be desirable to use this protruding chimney for various functionalities, such as for mounting or suspending the speaker. Also, when oriented as illustrated, or when supported on a stand, the cabinet does not require feet.

Figure 7:
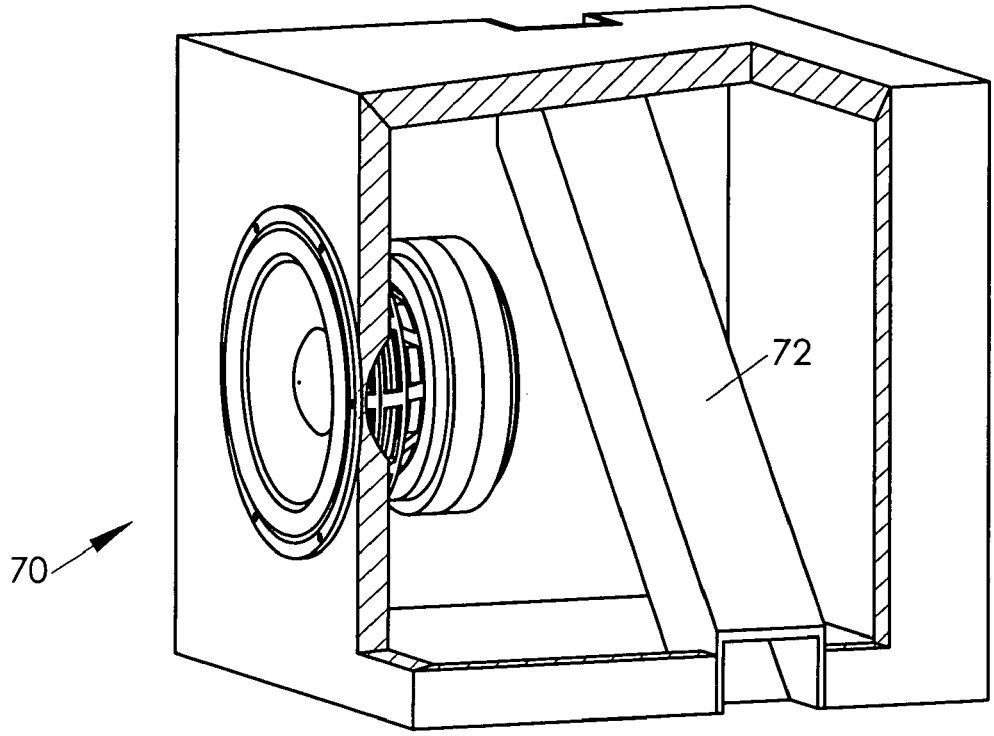
FIG. 7 shows a loudspeaker enclosure in which each end of the angled thermal chimney pierces two adjacent enclosure panels which meet at an edge of the enclosure, allowing it to function in a variety of orientations of the enclosure.

FIG. 7 illustrates another embodiment of a loudspeaker cabinet 70 in which the chimney 72 is placed at an angle. Rather than simply piercing opposite panels of the cabinet, the chimney pierces opposite edges. Two panels meet at each edge. This offers the advantage that, even if any particular panel is placed directly on a flat surface such as the floor, and its portion of the chimney opening is obstructed, the chimney opening in the adjacent side panel will not be obstructed. The chimney tube may need to be larger in this embodiment than in, for example, the embodiment of FIG. 2, to ensure that the non-obstructed portion of the downward chimney opening offers sufficient area to facilitate adequate airflow into the chimney. Alternatively, the ends of the chimney tube could be flared to provide increased cross-sectional area at the openings.

Figure 8:
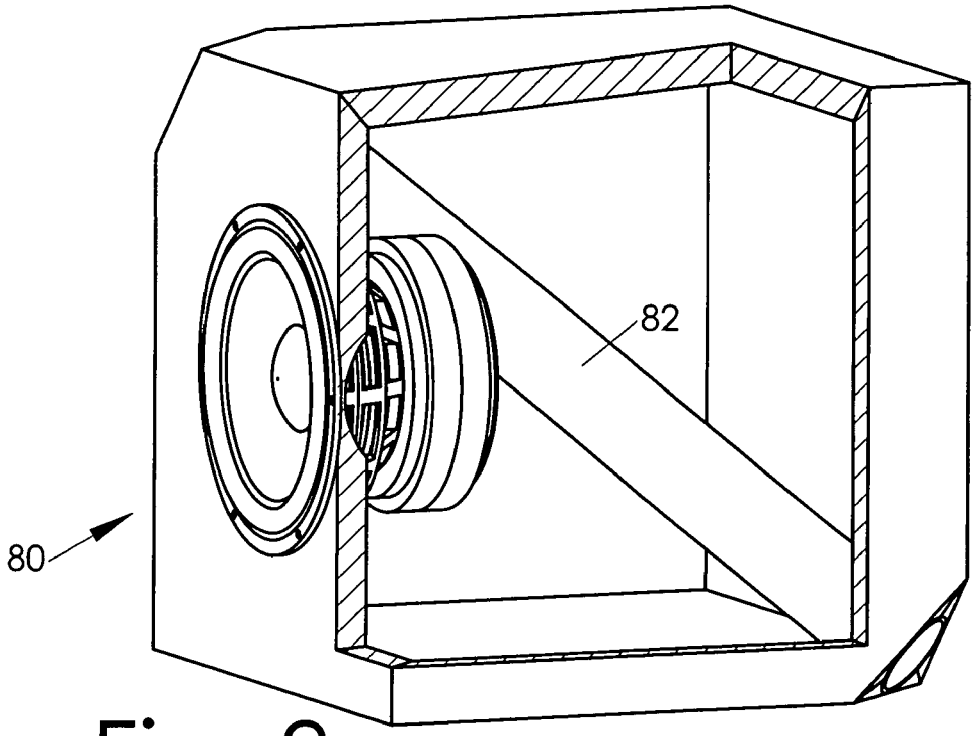
FIG. 8 shows a loudspeaker enclosure in which each end of the thermal chimney pierces three adjacent enclosure panels which meet at a corner of the enclosure, allowing even greater freedom in orienting the cabinet.

FIG. 8 illustrates another embodiment of a loudspeaker cabinet 80 in which the chimney tube 82 is placed at a compound angle. Each end of the chimney tube pierces three adjacent panels which meet at a corner of the cabinet. By extending corner-to-corner in this manner, the chimney cannot be easily obstructed and it remains in a sufficiently vertical orientation, regardless of which of the cabinet's panels is placed downward.

Figure 9:
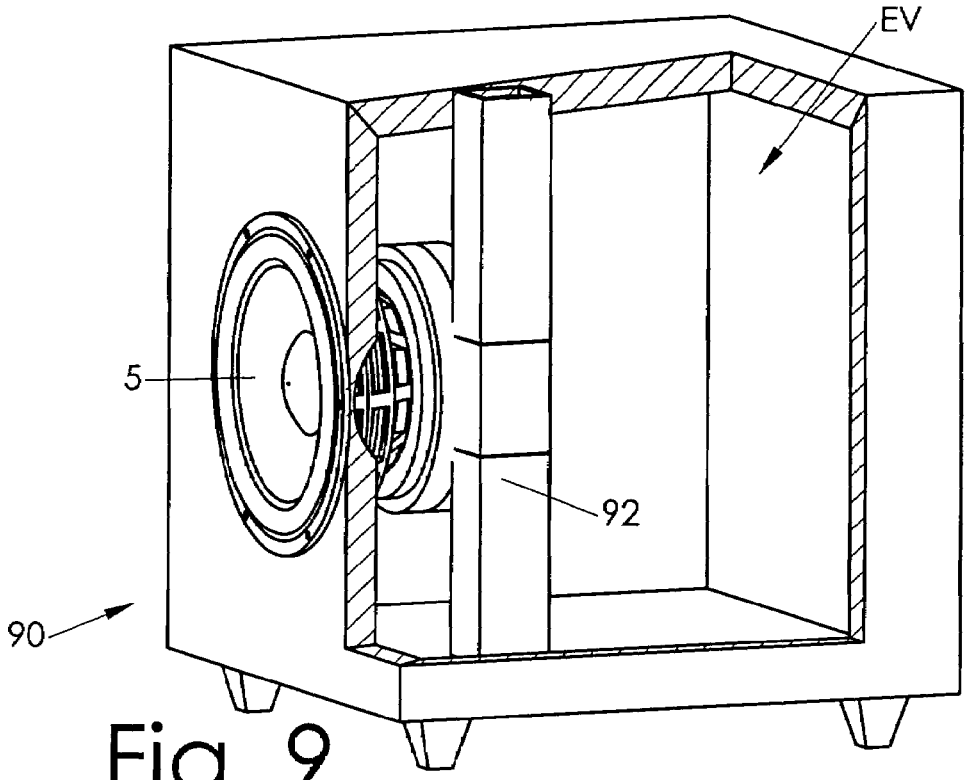
FIG. 9 shows a loudspeaker enclosure according to another embodiment, in which the thermal chimney is in direct contact with the loudspeaker.

FIG. 9 illustrates a loudspeaker cabinet 90 in which the chimney 92 is in direct contact with not only the enclosed air volume EV but also the speaker driver 5 itself. This will, of course, make the thermal transfer even more efficient. In some embodiments, the chimney may even be fabricated as a monolithic component of the speaker driver basket or frame (although it is here illustrated as being in contact with the motor structure, not part of the frame).

Is illustrated, the entire chimney itself is not necessarily of monolithic construction. In one embodiment, a portion of the frame serves as a middle portion of the chimney, and two chimney end sections are attached to it.

Figure 10:
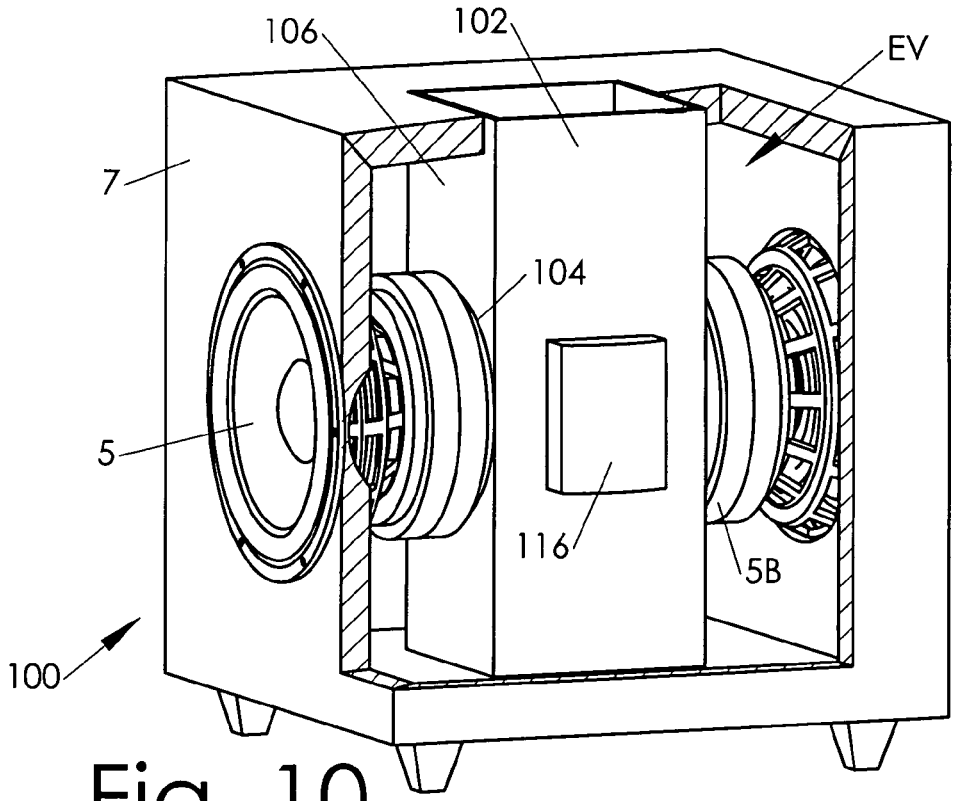
FIGS. 10 and 11 show another embodiment, in which the speaker driver is secured directly to the thermal chimney by screwing onto a threaded post of the chimney, and further illustrates a pair of speaker drivers operating in opposed, "boxer" fashion, and still further illustrates the use of an active cooling fan for even more cooling capability by the chimney.
Figure 11:
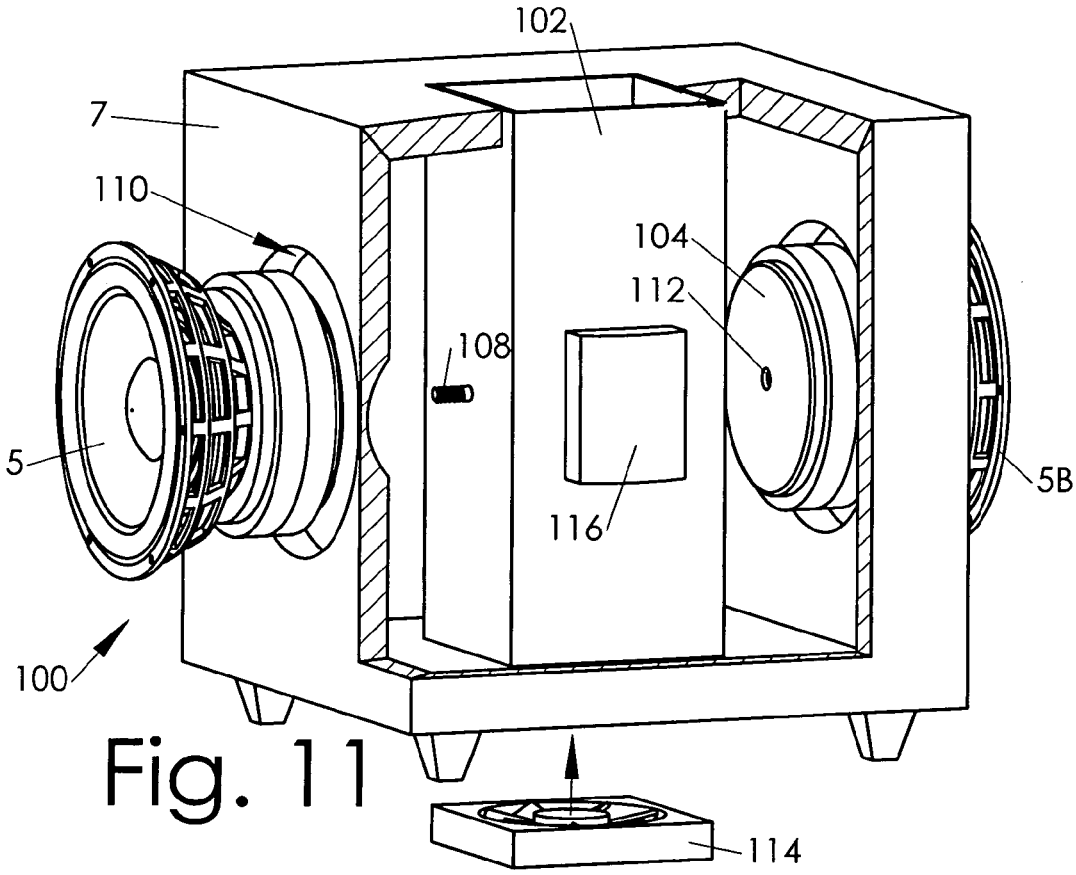

FIGS. 10 and 11 illustrate another loudspeaker cabinet 100 in which more than one speaker driver 5, 5B are heating the enclosed volume of air EV. A chimney 102 extracts this heat and transfers it to the outside air.

Many speaker drivers have a generally planar back surface 104, which can readily be placed into direct contact with the planar surface 106 of a rectangular chimney tube, as illustrated. This provides a large surface area of direct contact, and good thermal transfer. It may also be desirable to apply some thermal grease or the like to the mating surfaces, to improve thermal transfer.

In some embodiments, the speaker driver may be placed into contact with the surface of the chimney by carefully dimensioning the chimney and the cabinet, such that when the speaker driver is fastened to the front face 7 of the cabinet, the back of the driver just makes contact with the chimney.

In other embodiments, as illustrated, the chimney itself can be used to secure the speaker driver. In one such embodiment, the chimney is adapted with a threaded bolt 108 which is coaxially aligned with the hole 110 through which the speaker driver is inserted. The threaded bolt can be welded or integral with the chimney, or it can be inserted from inside the chimney through a hole. The back of the speaker driver includes a threaded hole 112 which mates with the threaded bolt. The driver is threaded down with the bolt until the back surface of the driver couples or bottoms firmly against the chimney. In some such embodiments, it may not even be necessary or desirable to fasten the front basket flange of the speaker driver to the panel. Rather, an airtight gasket may be provided, and the basket front mounting flange may cinch down against the gasket. The gasket may advantageously be made of highly damped material. Having the driver decoupled from the panel in this way may in many applications improve the acoustic performance by reducing panel resonance and vibration.

As illustrated, the drivers may be oriented in an opposing, "boxer" configuration, such that they prevent cabinet movement or rocking. The movements of the two respective speaker drivers are in opposition to each other, and cancel out each other's cabinet forces.

The performance of the chimney may, optionally, be enhanced by adding a fan 114 or other active cooling solution. In one such embodiment, the fan is a box fan whose outer dimensions closely match the internal dimensions of the chimney tube, and the fan is inserted inside the chimney so as not to protrude from the cabinet. It may be advantageous in some such applications to locate the fan near the bottom of the tube, such that much of the fan noise is directly absorbed by the carpet (not shown) on which the cabinet rests, and much of the remaining fan noise must travel the entire length of the chimney, which will attenuate the noise, before escaping the top opening of the chimney. The fan may be powered by any suitable means. For example, if the speaker is a powered subwoofer, it will already have an electrical power supply (not shown) from which a small amount of power may be drawn to power the fan.

In some embodiments, such as a powered subwoofer, the local amplifier 116 and/or other heat-generating electronics may be coupled directly to the chimney. They may be coupled to the outside of the chimney, as shown, where they will be in contact with the enclosed volume of air. Or, they may be coupled to the inside of the chimney, where they will be in contact with the rising column of air.

Figure 12:
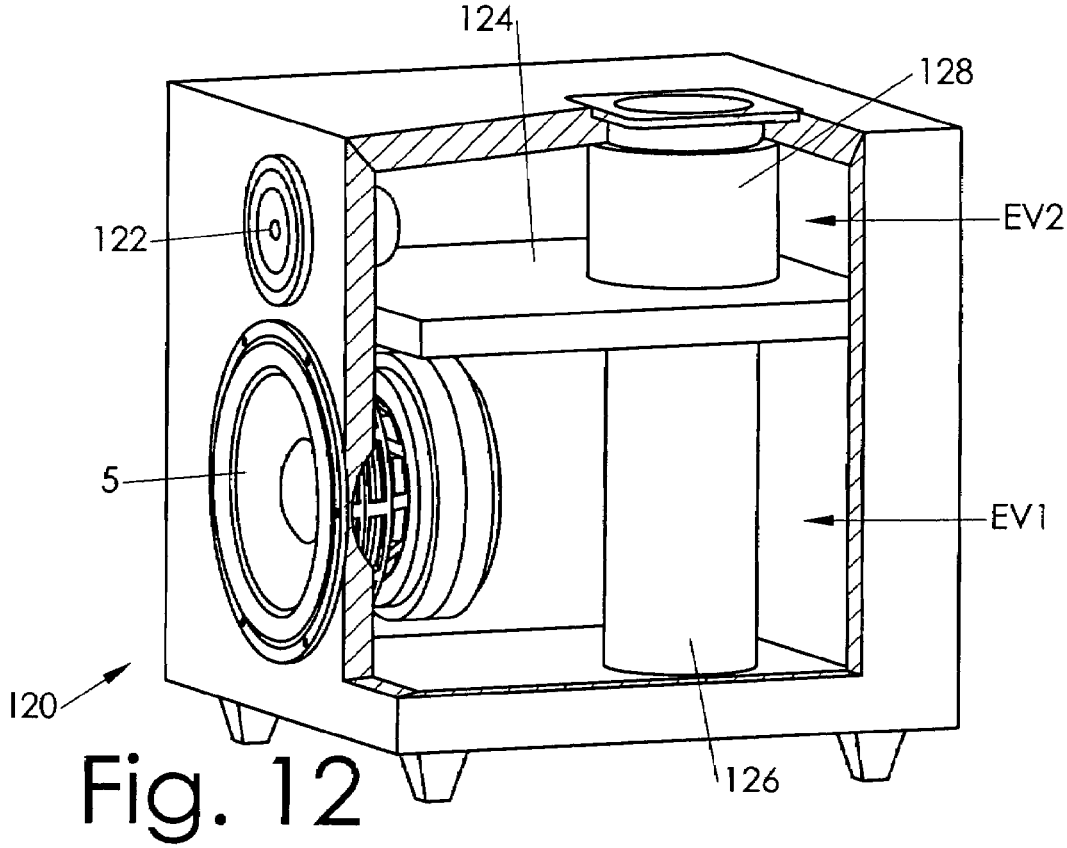
FIG. 12 shows another embodiment, in which the speaker cabinet includes two separately enclosed air volumes, each for use with a separate speaker driver.

FIG. 12 illustrates another embodiment of a loudspeaker cabinet 120 which includes a first speaker driver 5 and a second speaker driver 122. The cabinet includes a divider panel 124 which separates the internal volume of the cabinet into a first enclosed volume of air EV1 and a second enclosed volume of air EV2. The first speaker driver extends into, and heats, the first enclosed volume, and the second speaker driver extends into, and heats, the second enclosed volume. A thermal chimney 126 extends through the cabinet, cooling at least one of the enclosed volumes of air. The chimney may pierce the divider panel and extend through both enclosed air volumes, as shown, or it may extend through only one of the air volumes.

In some such embodiments, the two speaker drivers may exhibit radically different amounts of heating of their respective enclosed air volumes. In some such cases, it may be that the chimney is heated to a temperature which is between the temperatures of the two enclosed volumes. If this happens, the chimney will actually cause additional heating of the cooler of the two enclosed volumes, as heat travels through the material of the chimney, and into the air in the cooler enclosed volume. To prevent this from happening, the portion of the chimney which is in contact with the cooler enclosed air volume may be equipped with insulation 128, such as a foam sleeve as illustrated, to reduce this heating effect.

Figure 13:
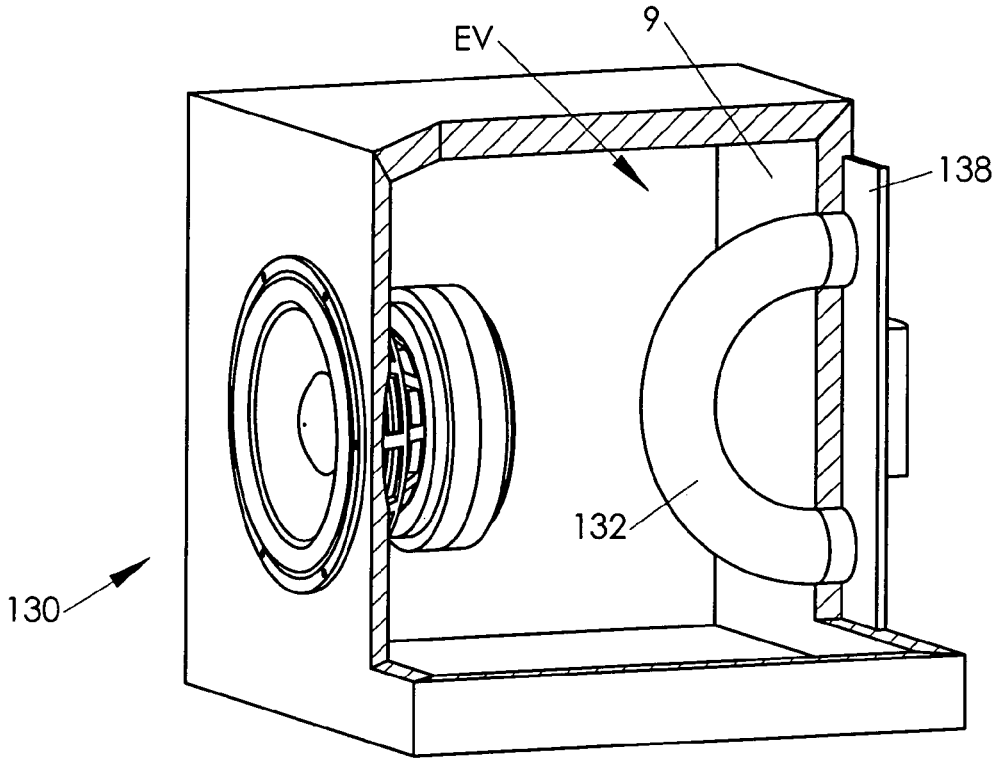
FIGS. 13 and 14 show another embodiment, in which both ends of the thermal chimney extend through the same panel of the enclosure.
Figure 14:
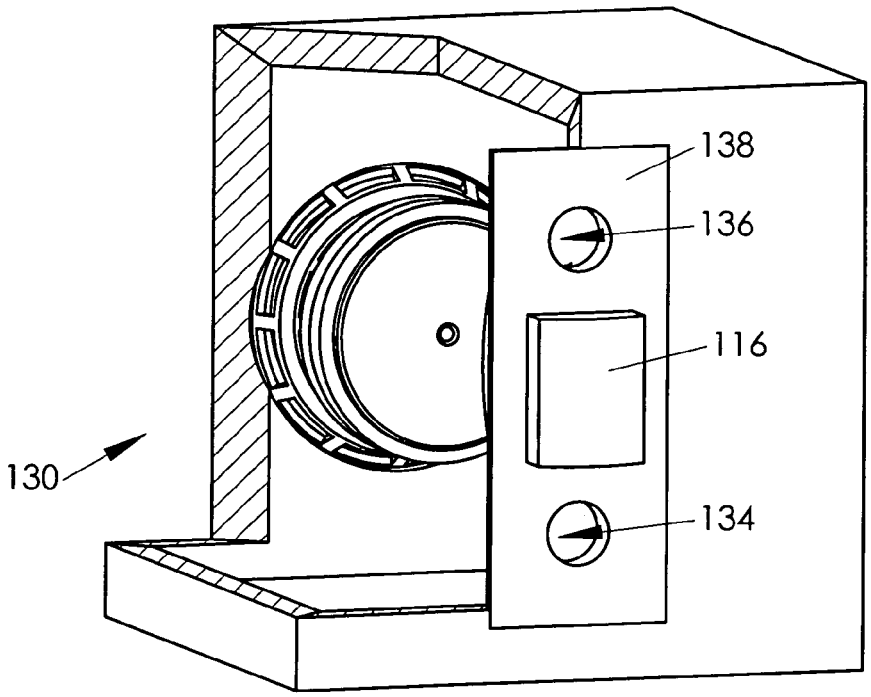

FIGS. 13 and 14 illustrate another embodiment of a loudspeaker cabinet 130 in which a chimney 132 pierces only a single panel 9 of the cabinet. The chimney may have any of a variety of configurations, such as the tubular "C" shape illustrated, or a flattened or compressed tube, or that like. The outer surface of the chimney is in contact with the enclosed volume of air EV. As the enclosed air heats the chimney, a rising column of air will be created inside the chimney tube, drawing cool air in the bottom opening 134 and expelling hot air out the top opening 136. The chimney may be provided with a flange or plate 138 which increases the surface area of the chimney which is in direct contact with the external ambient and allows for easy mounting of the chimney. The plate may include heat-shedding fins (not shown). The plate can be used for mounting the local amplifier 116 and other components such as the gain, crossover frequency, phase, and other controls (not shown).

Figure 15:
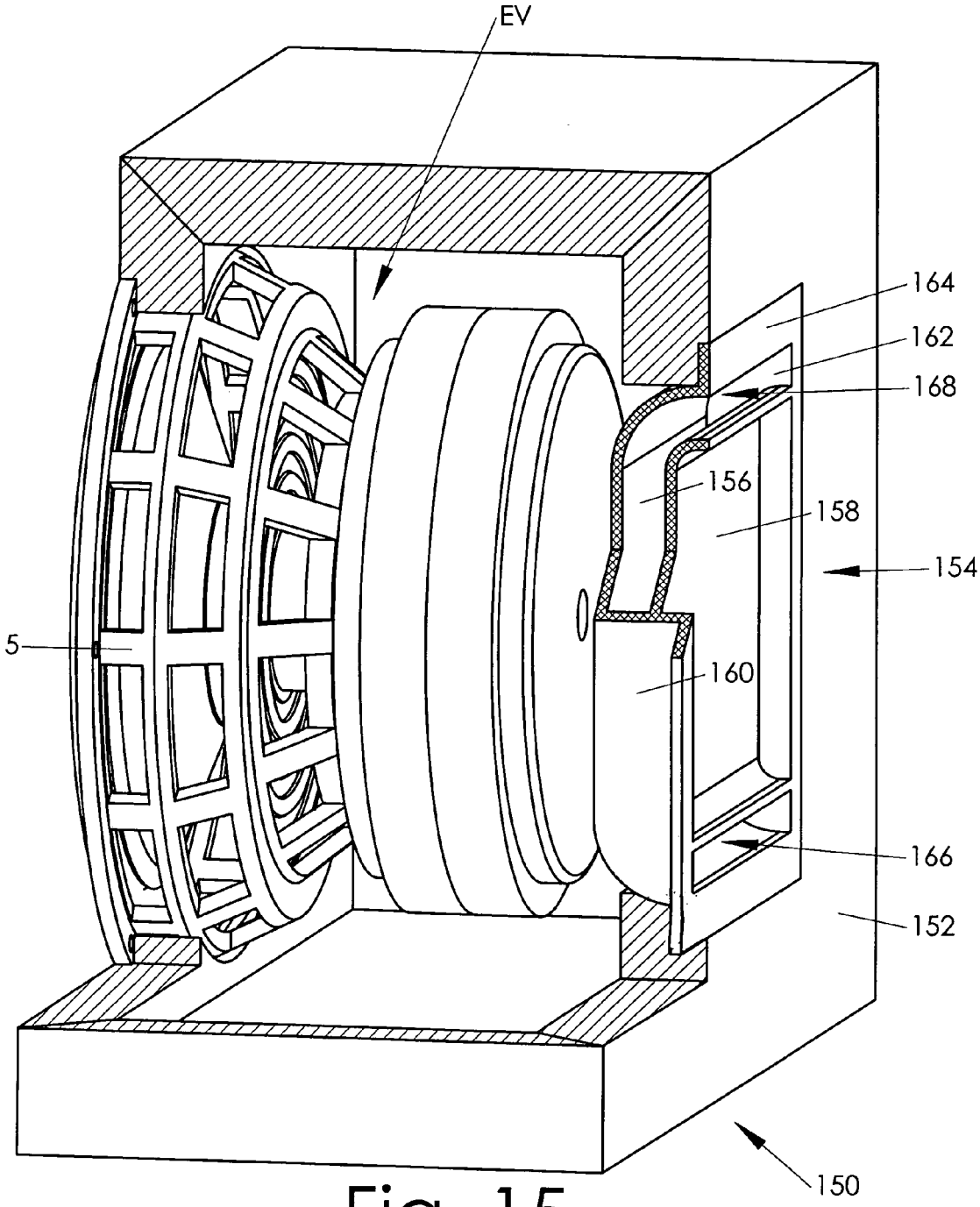
FIG. 15 shows another embodiment, in which the thermal chimney is a shallow slot, suitable for use in shallow cabinets.

FIG. 15 illustrates another embodiment of a loudspeaker cabinet 150 in which a chimney 154 pierces only a single panel of a cabinet 152. The chimney is very shallow, and therefore suitable for use in applications in which the cabinet must also be very shallow or in which there is limited clearance between the bottom of the speaker driver 5 and the back panel of the cabinet. One common such application is a truck box, in which a subwoofer is mounted in the shallowest possible cabinet and the required cabinet volume of enclosed air EV is provided according to the width of the truck box (generally corresponding to an axis normal to the page of FIG. 15).

The chimney includes an interior wall 156 and an exterior wall 158 of e.g. aluminum, which extend more or less parallel to each other, forming a vertical channel through which the column of air rises. The sides of the vertical channel are closed by side walls 160, 162 which are coupled with the interior and exterior walls. An optional flange 164 may be provided to facilitate mounting the chimney to the cabinet.

As the speaker driver is operated and heats the enclosed volume of air EV, the interior wall will conduct the heat to the column of air between the interior and exterior walls. The heated column of air will rise, drawing cool air into the lower opening 166 and expelling heated air out the upper opening 168. The exposed, outer surface of the exterior wall may be used for mounting the local amplifier (not shown) and its controls.

One problem with existing powered subwoofers is that, in many instances, their gain, crossover frequency, phase, etc. control knobs are required to pierce entirely through the plate to which the amplifier is mounted. If the amplifier shares the same volume of air as the speaker driver, and if the holes through which these knobs extend are not adequately sealed, the alternating pressurization of the cabinet caused by the moving diaphragm will cause whistling noise as air rushes in and out of the holes around the knobs. In the present embodiment, the amplifier (not shown) could reside within the thermal chimney, in which case the control knobs will extend only through the outermost wall 158, such that the control knob holes do not extend into the pressurized enclosed volume of air EV. Thus, this invention obviates the need to seal the holes around the knobs.

Figure 16:
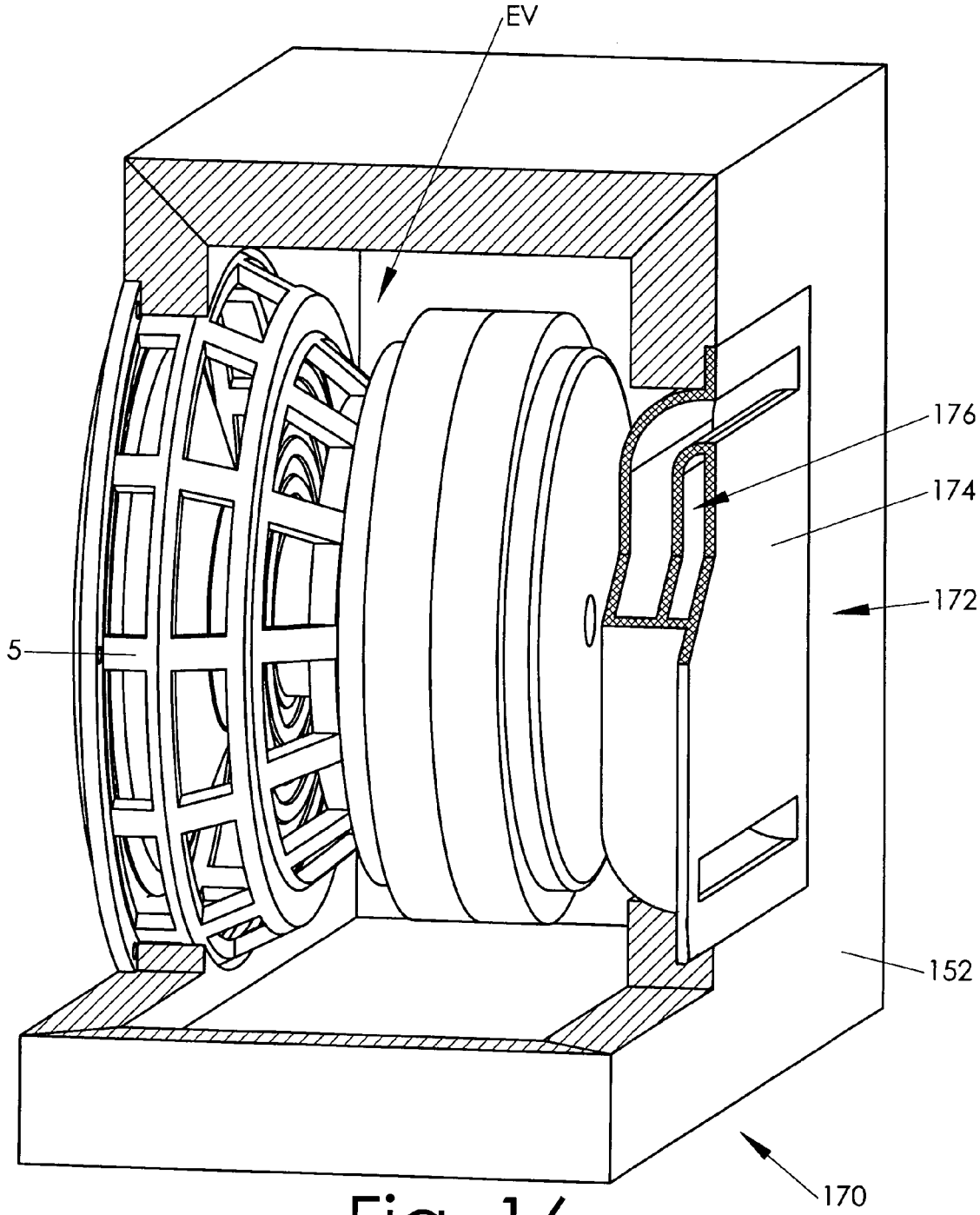
FIG. 16 shows another embodiment of a slot-shaped thermal chimney, adapted for integrating a local amplifier.

FIG. 16 illustrates another embodiment of a cabinet 170 including a shallow, single-panel thermal chimney 172. The chimney includes an additional wall 174 which encloses a space 176 where a power amplifier (not shown) could reside. The amplifier's power transistors and other heat-generating components may advantageously be affixed to the inside surface of the wall 174. The wall will conduct most of the amplifier's heat directly to the external ambient air. Some heating of the opposite wall will occur, but this will simply cause heating and rising of the column of air within the thermal chimney. Alternatively, the power transistors could be mounted on the opposite wall (158 in FIG. 15) in the space 176, but once again, this would simply utilize the passive, silent, self-regulating thermal extraction process provided by the thermal chimney.

CONCLUSION

The various features illustrated in the figures may be combined in many ways, and should not be interpreted as though limited to the specific embodiments in which they were explained and shown. Some loudspeaker cabinets house two or more speaker drivers, some of which may occupy separate enclosed volumes. The invention may be practiced with any number of these separate enclosed volumes. In some applications, the addition of a fan or blower to improve airflow through the chimney may be acceptable, such as in loudspeaker cabinets intended for use in very loud concerts, in which the fan noise will not be perceptible and the increased cooling is desirable.

The chimney tubes may take any suitable shape or size, and be fabricated of any suitable material. The chimney may be directly coupled to the cabinet panels, or there may be an acoustically dampening gasket between the chimney and the cabinet panels.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. A loudspeaker cabinet comprising:

a cabinet enclosing a volume of air;

a first speaker driver coupled to the cabinet and being in contact with the enclosed volume of air; and a first chimney coupled to the cabinet and having an outer surface in contact with the enclosed volume of air and an inner surface in contact with an external ambient;

the first chimney comprising a hollow tube having two open ends extending through the cabinet, through which the inner surface is in contact with the external ambient.

2. The loudspeaker cabinet of claim 1 wherein:

the cabinet has an orientation in which the cabinet is intended to be used; and the chimney is substantially vertical when the cabinet is in that orientation.

3. The loudspeaker cabinet of claim 1 wherein:

thermal conductivity of the chimney is higher than thermal conductivity of the cabinet.

4. The loudspeaker cabinet of claim 3 wherein:

the cabinet is substantially non-metallic; and the chimney is substantially metallic.

5. The loudspeaker cabinet of claim 1 further comprising:

feet coupled to the cabinet and providing clearance for an open end of the chimney.

6. The loudspeaker cabinet of claim 1 wherein:

the chimney has a substantially rectangular cross-sectional shape.

7. The loudspeaker cabinet of claim 1 wherein:

the cabinet is substantially sealed, whereby the enclosed volume of air is not significantly in contact with the external ambient.

8. A loudspeaker cabinet comprising:

a plurality of panels enclosing a volume of air; and a tubular chimney passing through at least one of the panels, the chimney including, an outer surface which is in direct contact with the enclosed volume of air, and an inner surface which is in direct contact with a column of air which is in communication with an external ambient; and wherein the chimney substantially seals the enclosed volume of air from the column of air.

9. The loudspeaker cabinet of claim 8 further comprising:

a speaker driver coupled to one of the panels;

wherein the speaker driver is in contact with the enclosed volume of air.

10. A method of cooling a volume of air enclosed within a loudspeaker cabinet, the method comprising:

absorbing heat from the enclosed volume of air into a first tubular chimney which passes through the cabinet so as to have an exterior surface in contact with the enclosed volume of air;

conducting the absorbed heat from the chimney into a column of air which is disposed within the chimney and in contact with an interior surface of the chimney and with an external ambient, thereby heating the column of air; and drawing unheated external ambient into an open lower end of the chimney in consequence of the heated column of air rising out an open upper end of the chimney into the external ambient.

* * * * *